US009810180B2

(12) United States Patent
Yoshida et al.

(10) Patent No.: US 9,810,180 B2
(45) Date of Patent: Nov. 7, 2017

(54) EGR COOLING STRUCTURE

(75) Inventors: Nobuyuki Yoshida, Saitama (JP); Hiroshi Takemoto, Saitama (JP); Taichi Yoshikawa, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 824 days.

(21) Appl. No.: 13/880,600

(22) PCT Filed: Oct. 12, 2011

(86) PCT No.: PCT/JP2011/073438

§ 371 (c)(1),
(2), (4) Date: Apr. 19, 2013

(87) PCT Pub. No.: WO2012/056885

PCT Pub. Date: May 3, 2012

(65) Prior Publication Data

US 2013/0206120 A1 Aug. 15, 2013

(30) Foreign Application Priority Data

Oct. 28, 2010 (JP) ..... 2010-242654

(51) Int. Cl.
*F02B 47/08* (2006.01)
*F02M 25/07* (2006.01)
(Continued)

(52) U.S. Cl.
CPC ..... *F02M 25/07* (2013.01); *F02M 26/13* (2016.02); *F02M 26/15* (2016.02); *F02M 26/28* (2016.02)

(58) Field of Classification Search
USPC ..... 123/41.79, 193.5, 568.13; 29/888.06
See application file for complete search history.

(56) References Cited

U.S. PATENT DOCUMENTS 6,152,118 A * 11/2000 Sasaki ..... F02D 21/08 123/568.21
6,422,215 B1 * 7/2002 McKay ..... 123/568.11

FOREIGN PATENT DOCUMENTS

CN 202381198 U 8/2012
JP 09-158791 A 6/1997
(Continued)

OTHER PUBLICATIONS

Machine Translation of JP2010150961A PDF File Name: "JP2010150961A_Machine_Translation.pdf".*
(Continued)

*Primary Examiner* — Carlos A Rivera
*Assistant Examiner* — Ruben Picon-Feliciano
(74) *Attorney, Agent, or Firm* — Squire Patton Boggs (US) LLP

(57) ABSTRACT

The EGR cooling structure includes a cylinder block having cylinders, and a cylinder head into which exhaust gas exhausted from the cylinders is collected. An exhaust emission control device is provided for purifying the exhaust gas exhausted from the cylinder head, and an EGR pipe is provided through which EGR gas of a part of the purified exhaust gas is introduced into an intake system. An EGR cooler is provided in the EGR pipe and cools the EGR gas with the cooling liquid. An exhaust gas passage leading from the cylinders to the exhaust gas purification device is curved when seen from a side, and the EGR cooler is disposed in the space surrounded by the cylinder block, the cylinder head, and the exhaust gas purification device.

6 Claims, 7 Drawing Sheets

(51) Int. Cl.

| | |
|---|---|
| ***F02M 26/13*** | (2016.01) |
| ***F02M 26/15*** | (2016.01) |
| ***F02M 26/28*** | (2016.01) |

(56) References Cited

FOREIGN PATENT DOCUMENTS

| | | | | |
|---|---|---|---|---|
| JP | 09158791 | A | * | 6/1997 |
| JP | 2001-073760 | A | | 3/2001 |
| JP | 2001073760 | A | * | 3/2001 |
| JP | 2004-108270 | A | | 4/2004 |
| JP | 2006-307759 | A | | 11/2006 |
| JP | 2006307759 | A | * | 11/2006 |
| JP | 2007332799 | A | | 12/2007 |
| JP | 2008-274846 | A | | 11/2008 |
| JP | 2010-150961 | A | | 7/2010 |
| JP | 2010150961 | A | * | 7/2010 |

OTHER PUBLICATIONS

Machine Translation of JP2006307759A PDF File Name: "JP2006307759A_Machine_Translation.pdf".*
Machine Translation of JP2001073760A PDF File Name: "JP2001073760A_Machine_Translation.pdf".*
Machine Translation of JP09158791A PDF File Name: "JP09158791A_Machine_Translation.pdf".*
Chinese Office Action application No. 201180051103.5 dated Sep. 26, 2014.
International Search Report, PCT/JP2011/073438 dated Jan. 17, 2012.

* cited by examiner

EGR COOLING STRUCTURE

CROSS-REFERENCE TO RELATED APPLICATIONS

This application is a National Stage entry of International Application No. PCT/JP2011/073438, filed Oct. 12, 2011, which claims priority to Japanese No. 2010-242654, filed Oct. 28, 2010. The disclosures of the prior applications are hereby incorporated in their entirety by reference.

FIELD OF THE INVENTION

The present invention relates to an EGR cooling structure.

DESCRIPTION OF THE RELATED ART

An EGR (Exhaust Gas Recirculation) system to introduce EGR gas of a part of exhaust gas from a vehicle engine (cylinder block) into an air intake system of the vehicle engine and have the EGR gas taken in by the vehicle engine has been known (See Patent Document 1). In the EGR system, the EGR gas flows into an EGR pipe, in which an EGR cooler to cool the EGR gas and an EGR valve to control an amount of the EGR gas flowing are installed.

PRIOR ART DOCUMENT

Patent Document 1: JP2008-274846A

SUMMARY OF THE INVENTION

Object to be Achieved

On the other hand, there is an exhaust emission control device which is attached in an exhaust pipe and intended to purify the exhaust gas. The exhaust emission control device is, for example, a catalytic converter including a catalytic converter (inclusive of a three-way catalyst), a DPF (Diesel Particulate Filter), or a GPF (Gasoline Particulate Filter). Such an exhaust emission control device to collect the exhaust gas from the engine as above mentioned is ought to be disposed immediately under an exhaust manifold (or exhaust manifold portion) to be warmed up quickly when the engine is started at relatively low temperatures.

If the exhaust emission control device is disposed in this way, both the exhaust emission control device and an EGR cooler are disposed on the exhaust side of the engine. As a result, it is necessary to make these apparatuses smaller and be disposed compactly.

Therefore it is an objective of the present invention to space-efficiently dispose the cylinder block, the exhaust emission control device and the EGR cooler and provide an EGR cooling structure that is made smaller.

Means to Achieve the Objective

In order to achieve this objective, an EGR cooling structure of the present invention comprising a cylinder block having a plurality of cylinders, an exhaust manifold port including a single tubular space into which exhaust gas exhausted from each of the plurality of cylinders flows, an exhaust emission control device for purifying the exhaust gas flowing from the exhaust manifold port, EGR pipes through which EGR gas of a part of the purified exhaust gas is introduced into an intake system, and an EGR cooler attached between the EGR pipes for cooling the EGR gas with cooling liquid, wherein an exhaust gas passage from each of the plurality of cylinders to the exhaust emission control device is curved when the exhaust gas passage is viewed from a side of the exhaust gas passage and the EGR cooler is disposed in a space surrounded by the cylinder block, the exhaust gas manifold portion and the exhaust emission control device.

Here the exhaust manifold portion includes (1) a cylinder head inclusive of an exhaust manifold, in which there is an exhaust manifold port (passage) connected with each of the cylinders, where exhaust gas exhausted from each of the cylinders is collected, or (2) a conventional exhaust manifold being a separate part from the cylinder head, with which each of the exhaust ports on the cylinder head to collect the exhaust gas.

According to this EGR cooling structure, the EGR cooler is disposed in a space surrounded by the cylinder block, the exhaust manifold portion and the exhaust emission control device. Therefore the surrounded space is efficiently used and the total EGR cooling structure is made smaller (compact).

The surrounded space is disposed between the cylinder block and the exhaust emission control device (1) so that the exhaust manifold portion and the exhaust emission control device are disposed close to each other, that is, the exhaust emission control device is installed immediately downstream of the exhaust manifold portion, in order to quickly warm up the exhaust emission control device by introducing the exhaust gas exhausted from the exhaust manifold portion and remaining at a high temperature into the exhaust emission control device, and (2) so that the cylinder block and the exhaust emission control device are disposed as close as possible to each other by connecting each of the cylinders with the exhaust emission control device through an exhaust gas passage which is seen curved when it is viewed from its side in order to make the structure smaller.

Here, although the EGR cooler is surrounded by the cylinder block, the exhaust manifold portion and the exhaust emission control device which becomes at high temperatures, there is no risk of the EGR cooler suffering deterioration or damage because the cooling liquid is flowing inside the EGR cooler.

In addition, since the cooling liquid at a low temperature flows through inside the EGR cooler, the EGR cooler has a function of blocking heat transmission. For example, heat to be transmitted from the exhaust emission control device to the cylinder block can be blocked or reduced. Therefore, it is possible to have such a device as a knock sensor which does not have high heat resistance disposed between the EGR cooler and the cylinder block. In other words, it is possible to have such a device as a knock sensor which does not have high heat resistance disposed without installing any heat shield plate.

Furthermore, as the cylinder block, the EGR cooler, the exhaust emission control device, a steering rod and a dash panel are disposed in this order toward the vehicle rear side from the cylinder block, the EGR cooler stays between the cylinder block and the exhaust emission control device and does not make direct contact with the steering rod or the dash panel when the front end of the vehicle collides and the cylinder block 11 (engine) moves rearward. Thus there is hardly a risk of the EGR cooler being badly deformed and the cooling liquid leaking out.

In the EGR cooling structure, it is preferable that the EGR cooler is fixed to the cylinder block, that the EGR pipe includes an EGR gas flow-in pipe made of a metal and connecting the EGR cooler with an exhaust gas pipe through which the exhaust gas flows, and that the EGR gas flow-in pipe is in a U-shape to absorb vibration transmitted from the exhaust gas pipe.

According to this EGR cooling structure, the EGR cooler is fixed to the cylinder block. Accordingly the EGR cooler is integrally coupled with the cylinder block and vibrates in synchronization with the cylinder block (engine).

Since the EGR gas flow-in pipe is in a U-shape to absorb vibration transmitted from through the exhaust gas pipe, it is difficult for the vibration from the exhaust gas pipe to be transmitted to the EGR cooler. Most of the downstream portion of the exhaust gas pipe up to a muffler is fixed to a frame that constitutes a vehicle body and vibrates at a different frequency from ones at which the engine and the vehicle body vibrate.

That is, the EGR cooler vibrates in synchronization with the cylinder block (engine) and the vibration of the exhaust gas pipe at a different frequency is absorbed by the EGR gas flow-in pipe in a U-shape. As a result, the vibration from the exhaust gas pipe is not input to the EGR cooler.

In the EGR cooling structure, it is preferable that the EGR cooler is detachably fixed to the cylinder block and has a plurality of fixing portions disposed outside the EGR emission control device in a way in which the plurality of fixing portions are seen when the cylinder block is viewed from a side of the EGR emission control device.

In the EGR cooling structure above mentioned, since the plurality of fixing portions aligned on the cylinder block are disposed outside the EGR emission control device in such a way that the plurality of fixing portions are seen when the cylinder block is viewed from a side of the EGR emission control device, the plurality of fixing portions are disposed in such a way that the plurality of fixing portions are seen when the EGR cooling structure, whose cylinder block (engine) from which exhaust gas is exhausted toward a rear end of the vehicle is disposed laterally with respect to the vehicle, is viewed from its rear side.

Due to this structure, the EGR cooler can be taken apart by putting through such a straight tool as a box driver onto each of the fixing portions without being interfered with by the exhaust emission control device with the exhaust emission control device installed.

Accordingly the EGR cooler can be attached and taken apart with the exhaust emission control device installed, which makes maintenance of the EGR cooler easier.

In addition, if the EGR cooler is secured to the cylinder block by tightening bolts, it is possible to attach the EGR cooler by temporarily tightening bolts first and subsequently attach the exhaust emission control device and tighten the bolts tightly.

In the EGR cooling structure, it is preferable that the EGR cooling structure further comprising a cooling liquid flow-in pipe made of a metal and connected with the EGR cooler, the cooling liquid flow-in pipe through which the cooling liquid flows into the EGR cooler, a cooling liquid flow-in hose connected with an upstream end of the cooling liquid flow-in pipe and made of a rubber or a resin, a cooling liquid flow-out pipe made of a metal and connected with the EGR cooler, the cooling liquid flow-out pipe through which the cooling liquid flows out of the EGR cooler, and a cooling liquid flow-out hose connected with an downstream end of the cooling liquid flow-out pipe and made of a rubber or a resin, and that the cooling liquid flow-in hose and the cooling liquid flow-out hose are disposed outside the exhaust emission control device when the cylinder block is seen from a side of the exhaust gas emission control device.

Since the cooling liquid flow-in hose and the cooling liquid flow-out hose, both of which are made of rubber or resin, are seen outside the exhaust emission control device when the cylinder block 11 is viewed from a side of the exhaust emission control device according to the EGR cooling structure above mentioned, it is difficult for heat of the exhaust emission control device to be transmitted to the cooling liquid flow-in hose and the cooling liquid flow-out hose and heat deterioration of those hoses is prevented.

In addition, the cooling liquid flow-in hose and the cooling liquid flow-out hose, both of which are made of rubber or resin, are so flexible to be capable of being bent freely are bent appropriately and to have the passage of the cooling liquid set to be any pathway.

Effect of the Invention

The present invention provides a compact EGR cooling structure in which a cylinder block, an exhaust emission and an EGR cooler are disposed in a smaller space. Various aspects and effects of the present invention and other aspects and additional features of the present invention ought to become more obvious based on the detailed explanation on exemplary and unrestricted embodiments with reference to the following figures

DETAILED DESCRIPTION OF THE EMBODIMENT

Figure 1:
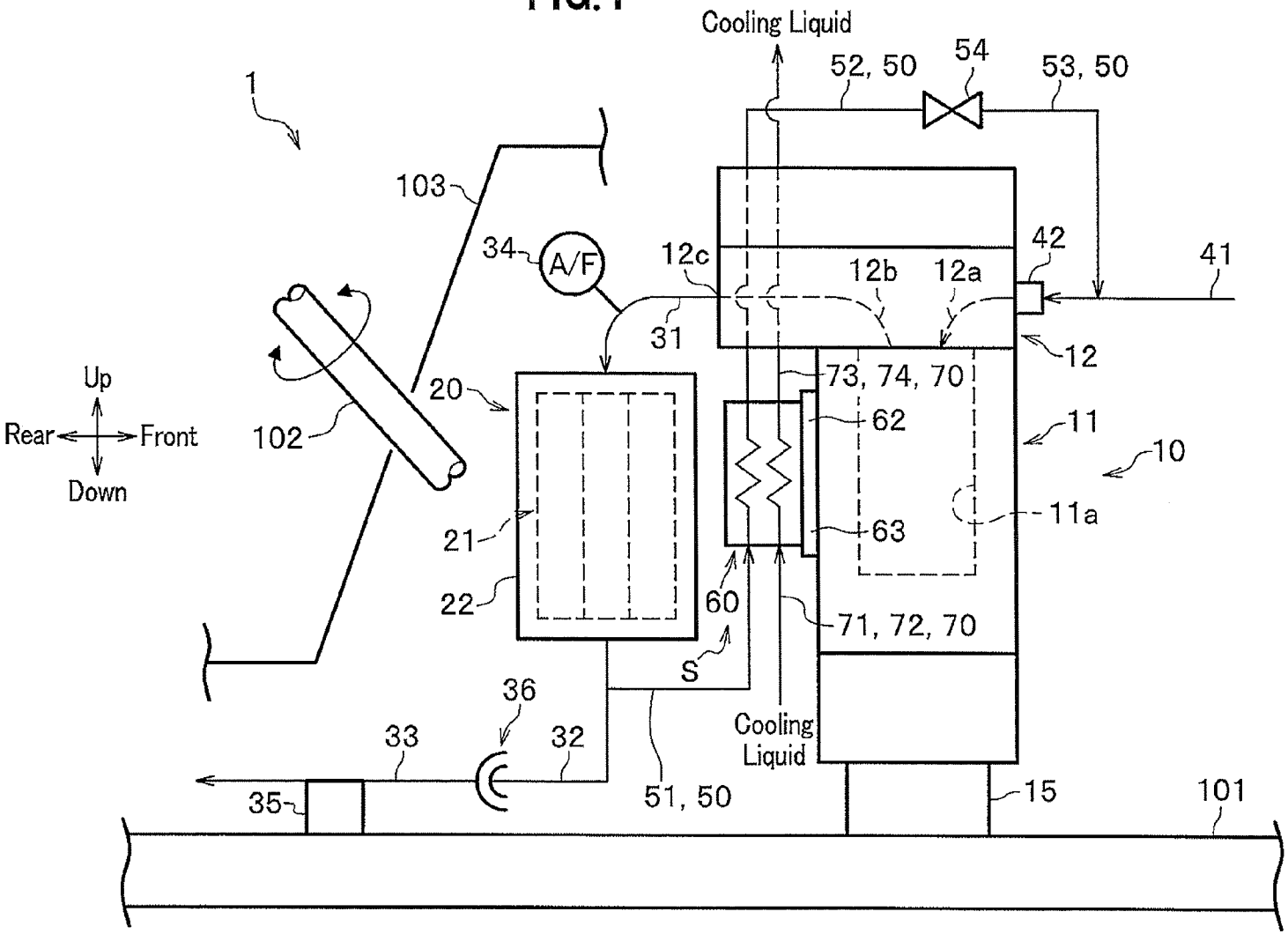
FIG. 1 is a figure representing schematically a configuration of an EGR cooling structure of a present embodiment and a left side elevation view of the EGR cooling structure showing schematically essential parts.

Hereinafter an embodiment of the present invention is to be explained with reference to FIG. 1 to FIG. 7.

<<Configuration of EGR Cooling Structure>>

An EGR cooling structure 1 of the embodiment is installed in an engine room under an engine hood of a vehicle and is equipped with an engine 10 (internal combustion engine), an exhaust emission control device 20 in which a three-way catalyst is included, a first exhaust gas pipe 31 through which exhaust gas flows from the engine 10 to the exhaust emission control device 20, second and third exhaust gas pipes 32, 33 through both of which the exhaust gas flows from the exhaust emission control device 20 to a muffler (not shown), an EGR pipe 50 through which part of the exhaust gas flowing from the second exhaust gas pipe 32 is introduced as EGR gas into an intake pipe 41, an EGR cooler 60 installed in the EGR pipe 50 to cool the EGR gas and a coolant pipe 70 through which coolant flow through the EGR cooler 60.

<Engine>

The engine 10 is configured to be a four cylinder in-line engine and disposed in parallel with a vehicle width direction. The engine 10 is fixed through a mount 15 to a frame 101 which is a part of a vehicle body (See FIG. 1). The engine 10 includes a cylinder block 11 through which four cylinders 11*a* are bored and a cylinder head 12 secured onto an upper surface of the cylinder block 11 with tightened bolts.

It should be noted that the engine 10 may be of any type for the embodiment, which means that the engine 10 is not limited to one shown in this embodiment, may have any number of cylinders which may be disposed in any direction and may be a V-type six cylinder engine, for example.

<Engine-Cylinder Head>

There are four intake ports 12*a* formed inside the cylinder head 12 to be in communication with four cylinders 11*a*. Through the intake ports 12*a* a mixture gas of fuel and air is introduced into the cylinders 11*a*. Each of the intake ports 12*a* is to be in communication with one of four cylinders 11*a* (See FIG. 4). The mixture gas of fuel and air coming through an intake pipe 41 is to be sucked into each of the cylinders 11*a* through an intake manifold 42 whose downstream portion branches into four pipe portions and one of the intake ports 12*a*.

Figure 4:
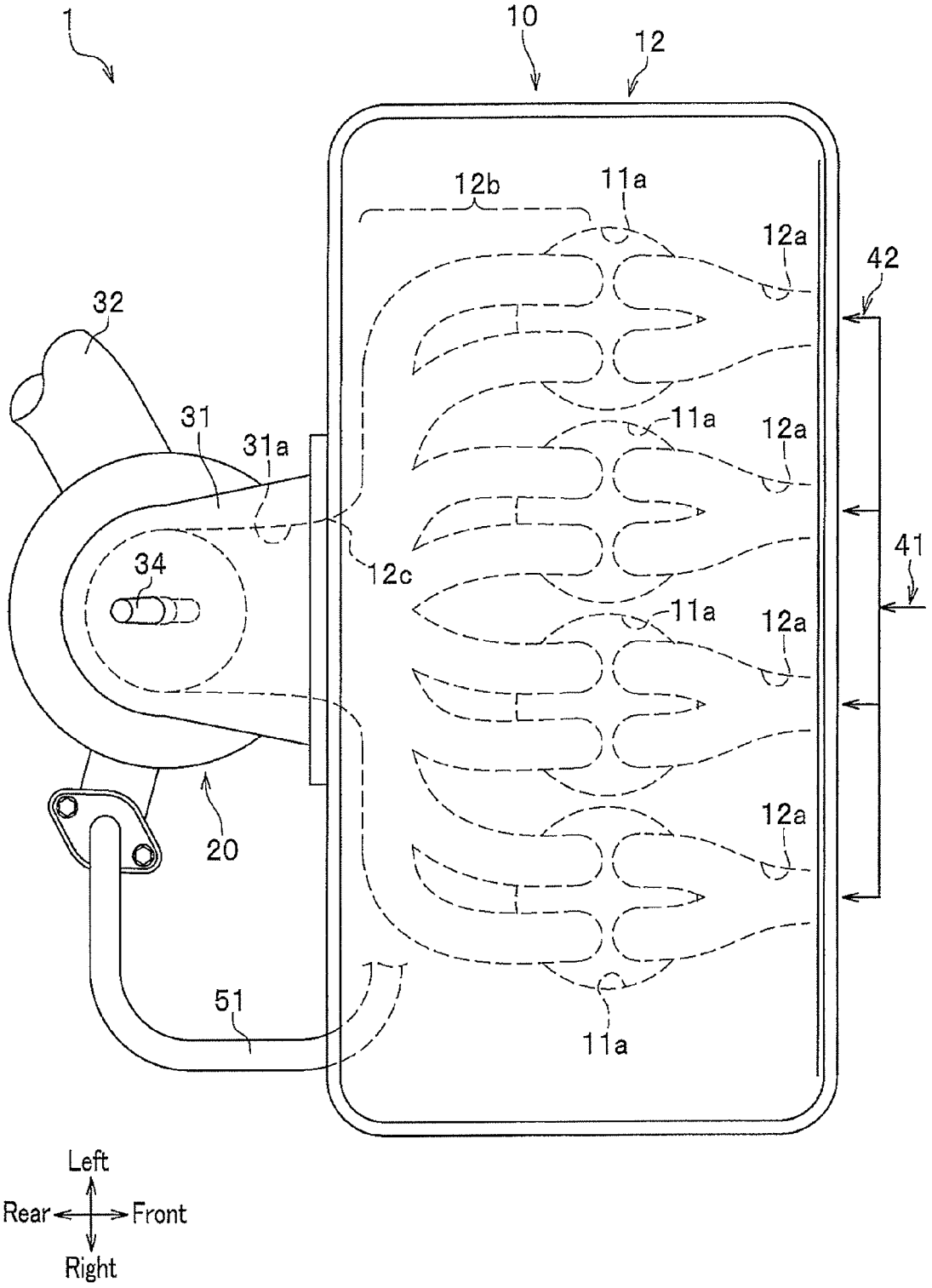
FIG. 4 is a plan view of the EGR cooling structure of the embodiment.

There is an exhaust manifold port 12*b* formed inside the cylinder head 12 (See FIG. 4). The exhaust manifold port 12*b* has four upstream portions each of which is in communication with one of the four cylinders 11*a* and a single downstream portion into which exhaust gas exhausted from the cylinders 11*a* collectively flows (See FIG. 4) and the exhaust gas exhausted from each the cylinders 11*a* is collected inside the cylinder head 12 while flowing through the exhaust manifold port 12*b* and further flows into a first exhaust gas pipe 31 that is connected with an outlet port 12*c* of the exhaust manifold port 12*b*.

Figure 3:
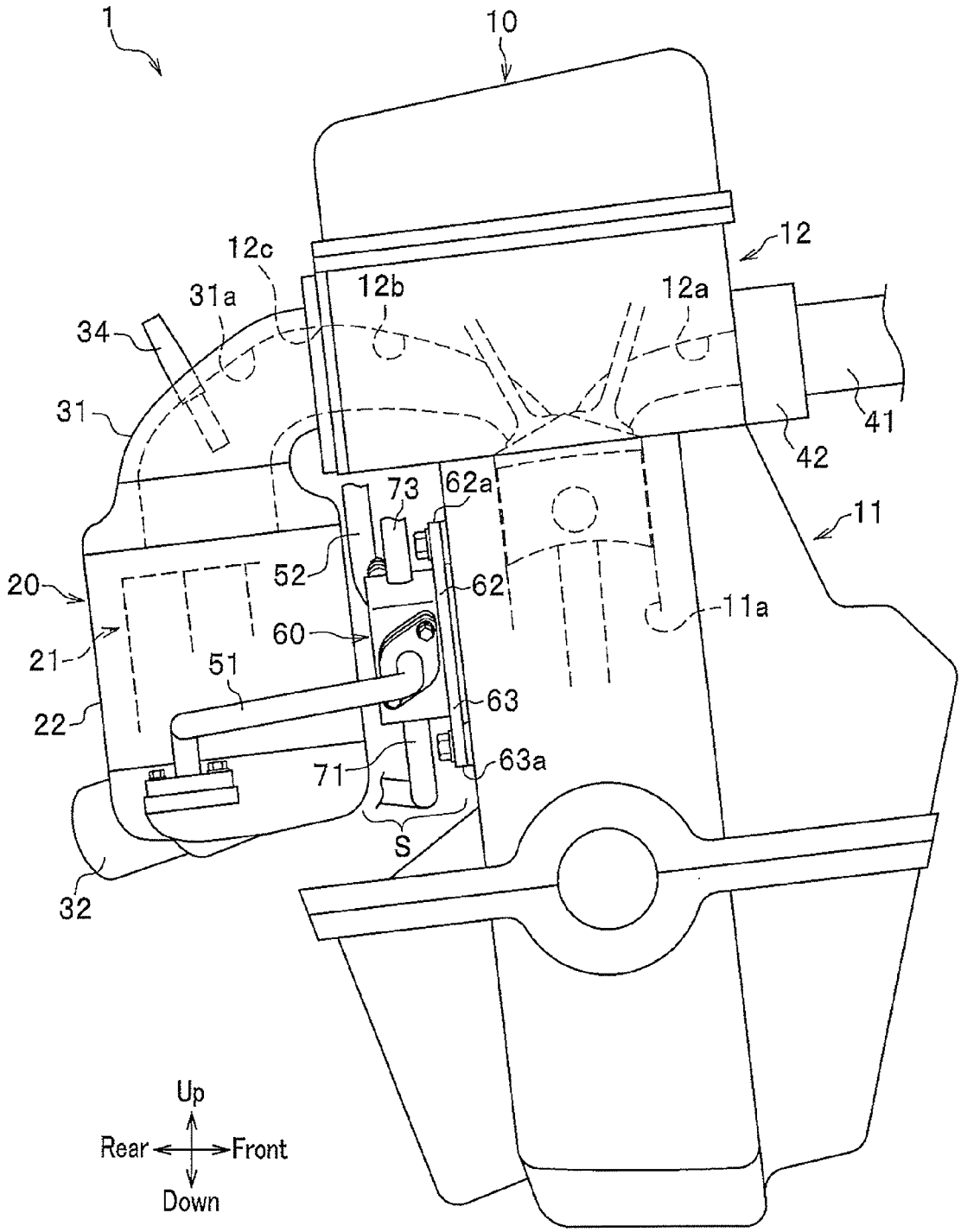
FIG. 3 is a left side elevation view of the EGR cooling structure of the embodiment.

Since the cylinder head 12 has an inner structure in which the exhaust manifold port 12*b* is formed as explained above, a length of the exhaust portion of the cylinder head 12 from the cylinders 11*a* in the front-rear direction of the engine 10 is longer than that of the intake portion of the cylinder head 12 from the cylinders 11*a* in the front-rear direction of the engine 10 (See FIG. 3).

Here the front-rear direction and the right-left direction are determined with respect to the vehicle.

As seen in FIG. 4, the exhaust manifold port 12*b* is symmetrically formed in the cylinder head 12 with respect to a symmetrical line that runs on a center of the four cylinders 11*a* lined in a row and is perpendicular to the row of the four cylinders 11*a*. The outlet port 12*c* is disposed on the symmetrical line in the plan view of the engine 10. Since the cylinder head 12 has this inner structure, the exhaust gas exhausted from each of the four cylinders 11*a* is made to flow efficiently through the exhaust manifold port 12*b* to the outlet port 12*c*. However the exhaust manifold port 12*b* may be asymmetrically formed in the cylinder head 12.

<First Exhaust Gas Pipe>

A first exhaust gas pipe 31 is connected between the outlet port 12*c* of the exhaust manifold port 12*b* and an incoming end of the exhaust emission control device 20, and the exhaust gas coming through the exhaust manifold port 12*b* is introduced through the first exhaust gas pipe 31 into the exhaust emission control device 20. The first exhaust gas pipe 31 is a very thick pipe made of a metal and substantially in a shape of a quarter of a circle when viewed from its side, as seen in FIG. 3. The first exhaust gas pipe 31 has a flange portion which is formed at its upstream end and fixed to the cylinder head 12 and another flange portion which is formed at its downstream end and fixed to a case 22 made of a metal (for example, stainless steel) which is included by the exhaust emission control device 20. Thus the first exhaust gas pipe 31 and the exhaust emission control device 20 are integrally coupled with the cylinder head 12 (in engine 10).

There is an exhaust gas passage 31*a* formed in the first exhaust pipe 31. Since this exhaust gas passage 31*a* is substantially in a shape of a quarter of a circle, the direction in which the exhaust gas flows is altered while the exhaust gas is flowing in the exhaust gas passage 31*a* and the exhaust gas exhausted rearward in the horizontal direction from the cylinder head 12 flows downward in the vertical direction. A curvature of the exhaust gas passage 31*a* is set in a way that a pressure drop of the exhaust gas is sufficiently small (See FIG. 3).

Since the exhaust gas flows downward in the vertical direction, the exhaust emission control device 20 may be disposed in parallel with the cylinder block 11 while the exhaust emission control device 20 is spaced a predetermined distance apart from the cylinder block 11. As a result, there is hardly a dead space remaining between the cylinder block 11 and the exhaust emission control device 20, and as a result, the engine 10 is made smaller. Moreover, since the exhaust gas flows downward in the vertical direction, the exhaust gas flows into all of small diameter holes in a honeycomb body 21 homogeneously and the exhaust gas is efficiently purified.

Furthermore, since the exhaust gas exhausted from the cylinder head 12 flows through the first exhaust gas pipe 31 (exhaust gas passage 31*a*) that is very thick and short, the exhaust gas flowing into the exhaust emission control device 20 remains at a high temperature and the exhaust emission control device 20 warms up quickly even when the engine 10 is started at a relatively low temperature in the atmosphere.

In this embodiment, "an exhaust gas passage from each of the cylinders 11*a* to the exhaust emission control device 20" includes the exhaust manifold port 12*b* in the cylinder head 12 and the exhaust gas passage 31*a* formed in the first exhaust gas pipe 31. The exhaust gas passage 31*a* in "exhaust gas passage" is curved and in a shape of a quarter of a circle.

Since the cylinder head 12 extends rearward from the cylinder block 11 as explained and the first exhaust gas pipe 31 is in a shape of a quarter of a circle, there is a space S which is disposed between the cylinder block 11 and the exhaust emission control device 20 and surrounded by the cylinder block 11, the cylinder head 12 (exhaust manifold portion) and the exhaust emission control device 20 (See FIG. 1 and FIG. 3). Because the space S is heated by the cylinder block 11 and the exhaust emission control device 20, no device that is not capable of withstanding high temperatures can be placed in the space S. Therefore the space S could be a dead space. However an EGR cooler 60 is installed in the space S and the space S is efficiently used in the present embodiment. As a result, the EGR cooling structure 1 is made smaller.

There is a LAF sensor 34 attached onto the first exhaust pipe 31 to measure a combustion air-fuel ratio.

<Exhaust Emission Control Device>

The exhaust emission control device 20 includes such a three-way catalyst of a Pt type or a Rh type and intended to purify HC, CO and NOx remaining in the exhaust gas. To be more specific, the exhaust emission control device 20 includes a honeycomb body 21, in which there are a plurality of thin holes extending in the vertical direction and on which the three-way catalyst is supported, and a case 22 that is made of a metal and houses the honeycomb 21.

<Second and Third Exhaust Gas Pipes>

A second exhaust gas pipe 32 and a third exhaust gas pipe 33 are pipes through which the exhaust gas flowing out of the exhaust emission control device 20 is introduced into a muffler (not shown). The exhaust gas flows through the second exhaust gas pipe 32 and the exhaust gas pipe 33 in this order to the muffler.

An upstream end of the exhaust gas pipe 32 is fixed to the exhaust emission control device 20 and the exhaust gas pipe 32 is integrally coupled with the engine 10 through the exhaust emission control device 20 and the exhaust gas pipe 31. Therefore the second exhaust gas pipe 32 receives mainly vibration transmitted from the engine 10.

On the other hand, the third exhaust gas pipe 33 is fixed to a frame 101 (vehicle body) through a bracket 35. Accordingly the third exhaust pipe 33 vibrates independently of the engine 10 at a frequency that is different from one at which the engine 10 vibrates.

The third exhaust pipe 33 is connected with the second exhaust pipe 32 through a spherical surface joint 36 (See, for example, JP2004-108270A). Due to this joint used, it is difficult for vibration to be transmitted between the second exhaust pipe 32 and the third exhaust pipe 33. However part of vibration on the third exhaust pipe is transmitted to the second exhaust pipe 32 through the spherical surface joint 36

<EGR Pipe>

An EGR pipe 50 includes a first pipe 51 (EGR gas flow-in pipe), a second pipe 52 and a third pipe 53 (See FIG. 1). Each of the first pipe 51, the second pipe 52 and the third pipe 53 is made of a metal such as stainless steel does not suffer heat deteriorate due to heat from the EGR gas, the exhaust gas emission device 20 and the like.

Figure 2:
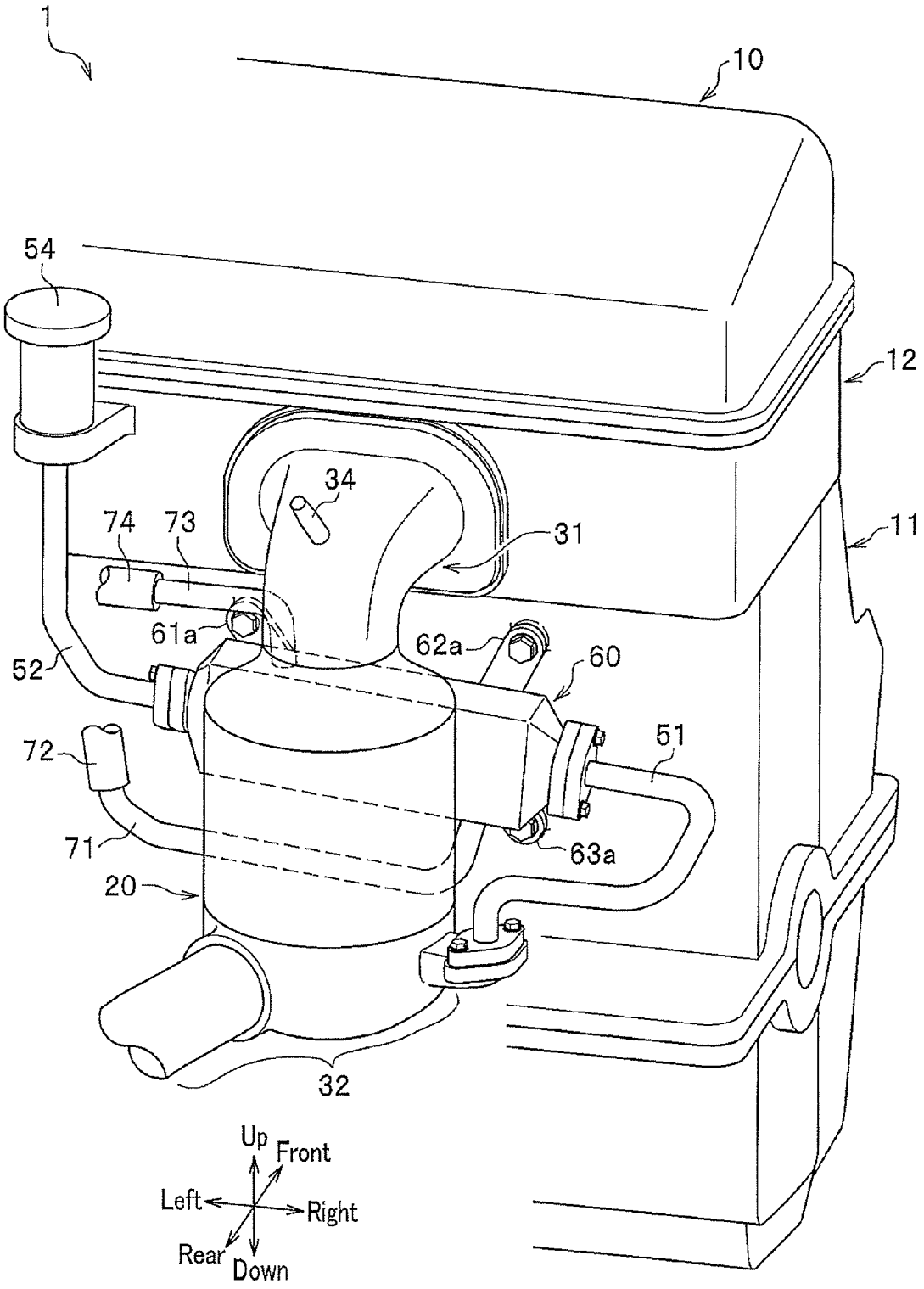
FIG. 2 is a perspective view of an EGR cooling structure of the embodiment.
Figure 5:
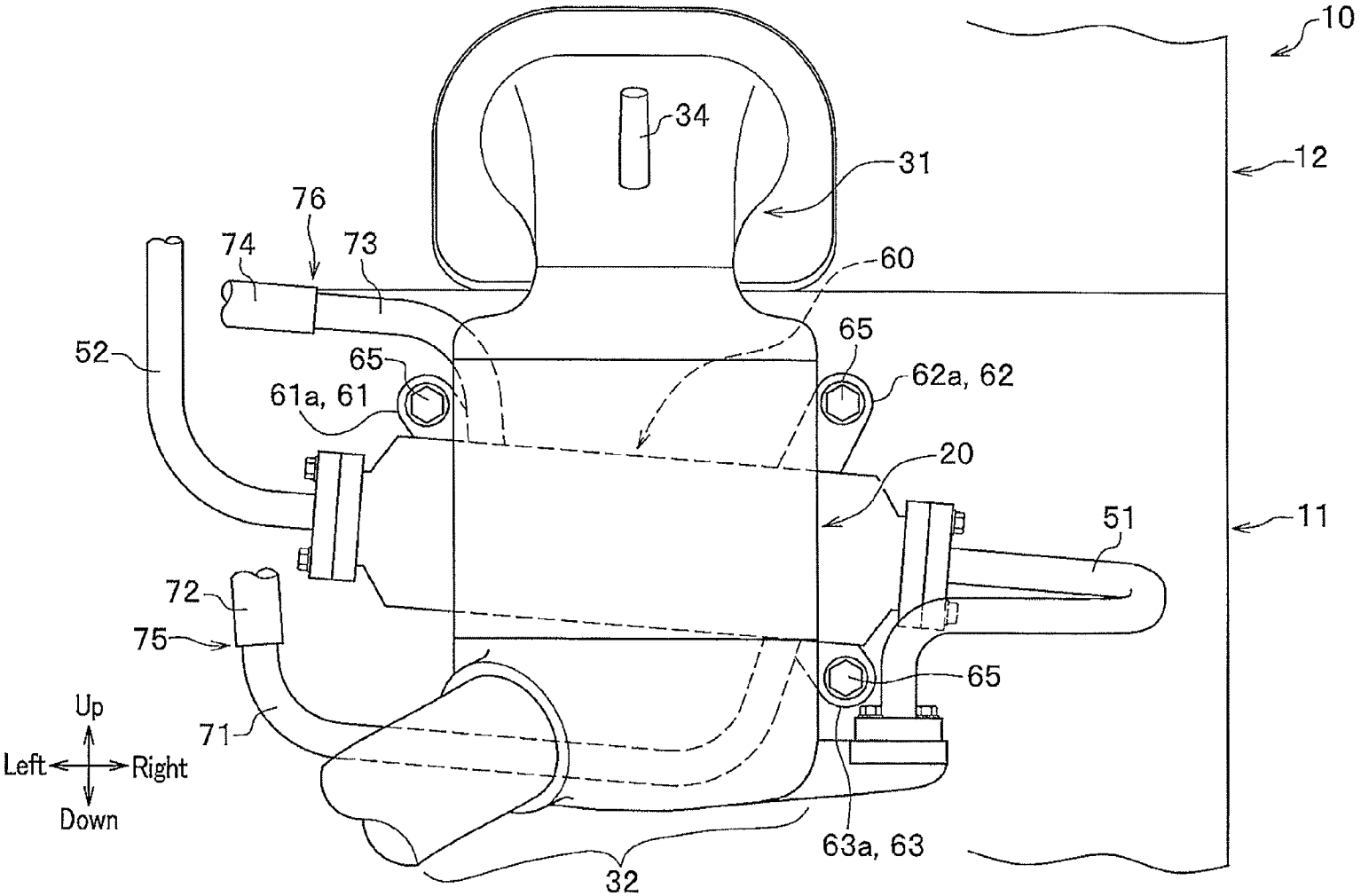
FIG. 5 is a view of the EGR cooling structure of the embodiment when it is seen from its rear side.

The first pipe 51 (EGR gas flow-in pipe) is connected between the second exhaust gas pipe 32 and an EGR gas incoming port of the EGR cooler 60 (See FIG. 1, FIG. 2 and FIG. 5). Part of the exhaust gas in the second exhaust gas pipe 32 flows as EGR gas out of the second exhaust gas pipe 32 through the first pipe 51 to the EGR gas cooler 60.

Since the part of the exhaust gas which has been purified through the exhaust emission control device 20 to reduce HC, NOx and the like flows as the EGR gas from downstream of the exhaust emission control device 20 to the EGR cooler 60, the EGR cooler 60 does not suffer deterioration due to HC, NOx and the like.

Moreover the first pipe 51 is more or less in a U-shape to absorb vibration transmitted from the second exhaust gas pipe 32 (See FIGS. 2 to 6). The first pipe 51 in the U-shape enables vibration transmitted to the second exhaust pipe 32 from the third exhaust pipe 33 being efficiently absorbed by the first pipe 51 and hardly transmitted to the EGR cooler 60. As a result, the vibration on the third exhaust pipe, whose vibration frequency is different from one at which the engine 10 vibrates, is hardly transmitted to the EGR cooler 60 that is fixed to the cylinder block 11 (engine 10) and vibrates in synchronization with the engine 10 and it is difficult for the EGR cooler 60 to fracture.

In addition, the first pipe 51 that is attached slightly inclines with the joint with the second exhaust gas pipe 32 being lowest (See FIG. 3 and FIG. 5). Due to this inclination, condensed water produced of the EGR gas that is cooled in the EGR cooler 60 flows down through the first pipe 51 into the second exhaust gas pipe 32 to be discharged.

An EGR gas outlet of the EGR cooler 60 is connected with an intake pipe 41 (in an intake system) through the second pipe 52, an EGR valve 54 and the third pipe 53 (See FIG. 1). The EGR gas cooled in the EGR cooler 60 is introduced into the intake pipe 41 through the second pipe 52, the EGR valve 54 and the third pipe 53.

The EGR valve 54 is a flow rate control valve to control a flow rate of the EGR gas. An opening degree of the EGR valve is controlled by ECU (Electronic Control Unit) which is not shown.

<EGR Cooler>

The EGR cooler 60 is a heat exchanger of a liquid cooling type to cool with cooling liquid the EGR gas that flows through the EGR pipe 50. The EGR cooler 60 is installed in the above mentioned space S surrounded by the cylinder block 11, the cylinder head 12 (exhaust manifold portion) and the exhaust emission control device 20 (See FIG. 3).

The EGR cooler 60 is in a shape of an elongated quadrangular prism and has a longitudinal direction along the left-right direction. After the EGR gas flows in the EGR cooler 60 through an EGR gas inlet disposed at the right side of the EGR cooler 60, the EGR gas is flowing in the left direction in the EGR cooler 60 while being cooled. Then the EGR gas flows out of the EGR cooler 60 through an EGR gas outlet disposed at the left side of the EGR gas cooler after the EGR gas is cooled (See FIG. 6).

The EGR cooler 60 is installed to incline in such a way that a portion of the EGR cooler 60 on the first pipe 51 is disposed slightly lower than the other portion and the condensed water produced of the EGR gas being cooled is to be discharged through the first pipe 51.

In addition, the EGR cooler 60 is fixed to the cylinder block 11 with three bolts 65.

To be specific, there are three leg portions, a leg portion 61, a leg portion 62 and a leg portion 63, which are formed on the EGR cooler 60 and disposed on a side of the cylinder block 11. Tip portions of the leg portions 61, 62, 63 have fixing portions 61*a*, 62*a*, 63*a* to be disposed on the cylinder block 11. Each of the fixing portions 61*a*, 62*a*, 63*a* has a through hole through which a bolt 65 is put. The bolt 65 is further screwed into a threaded hole 11*b* bored on the back face of the cylinder block 11 (See FIG. 7) and the EGR cooler 60 is fixed to the cylinder block 11.

However, this is not only a way to have the EGR cooler 60 fixed to the cylinder block 11 and there should be other ways to do it.

The fixing portions 61*a* to 63*a* are disposed and distributed right and left outside the exhaust emission control device 20 in such a way that the fixing portions 61*a* to 63*a* are seen when the cylinder block 11 is viewed from its back side (where the exhaust emission control device 20 is) with each of the exhaust emission control device 20 and the EGR cooler 60 assembled.

Because of the fixing portions 61*a* to 63*a* disposed in this way, it is possible to unscrew the bolts 65 with such a straight tool as a screw driver without having the tool interfere with the exhaust emission control device 20 and take apart the EGR cooler 60 by having the EGR cooler 60 slide in the left or right direction (See arrow A1 in FIG. 7), even when the exhaust emission control device 20 is attached to the engine 10, that is, when the exhaust emission control device 20 is integrally coupled with cylinder head 12 (engine 10) through the exhaust gas pipe 31.

The fixing portion 61*a* is disposed on the left side of the exhaust emission control device 20 and the fixing portions 62*a*, 63*a* are disposed on the right side of the exhaust emission control device 20. That is, the fixing portions 61*a*, 62*a*, 63*a* are distributed on both left-right sides of the EGR cooler 60 which is elongated in the left-right direction.

Therefore the EGR cooler 60 is more stably fixed to the cylinder block 11 than it is fixed with one side fixation.

<Cooling Liquid Pipe>

Figure 6:
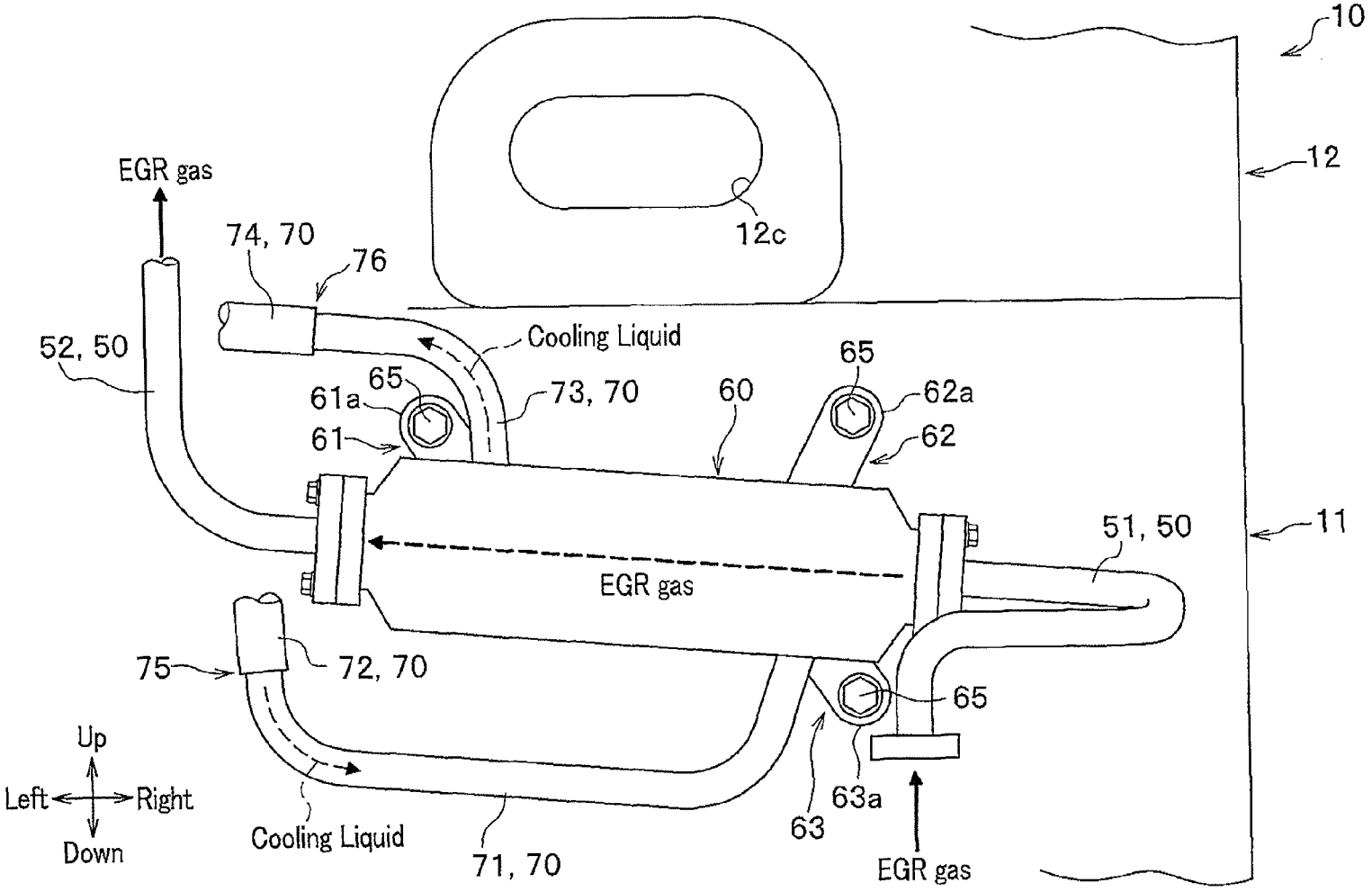
FIG. 6 is a view of the EGR cooling structure of the embodiment with an exhaust emission control device taken apart when it is viewed from its rear side.
Figure 7:
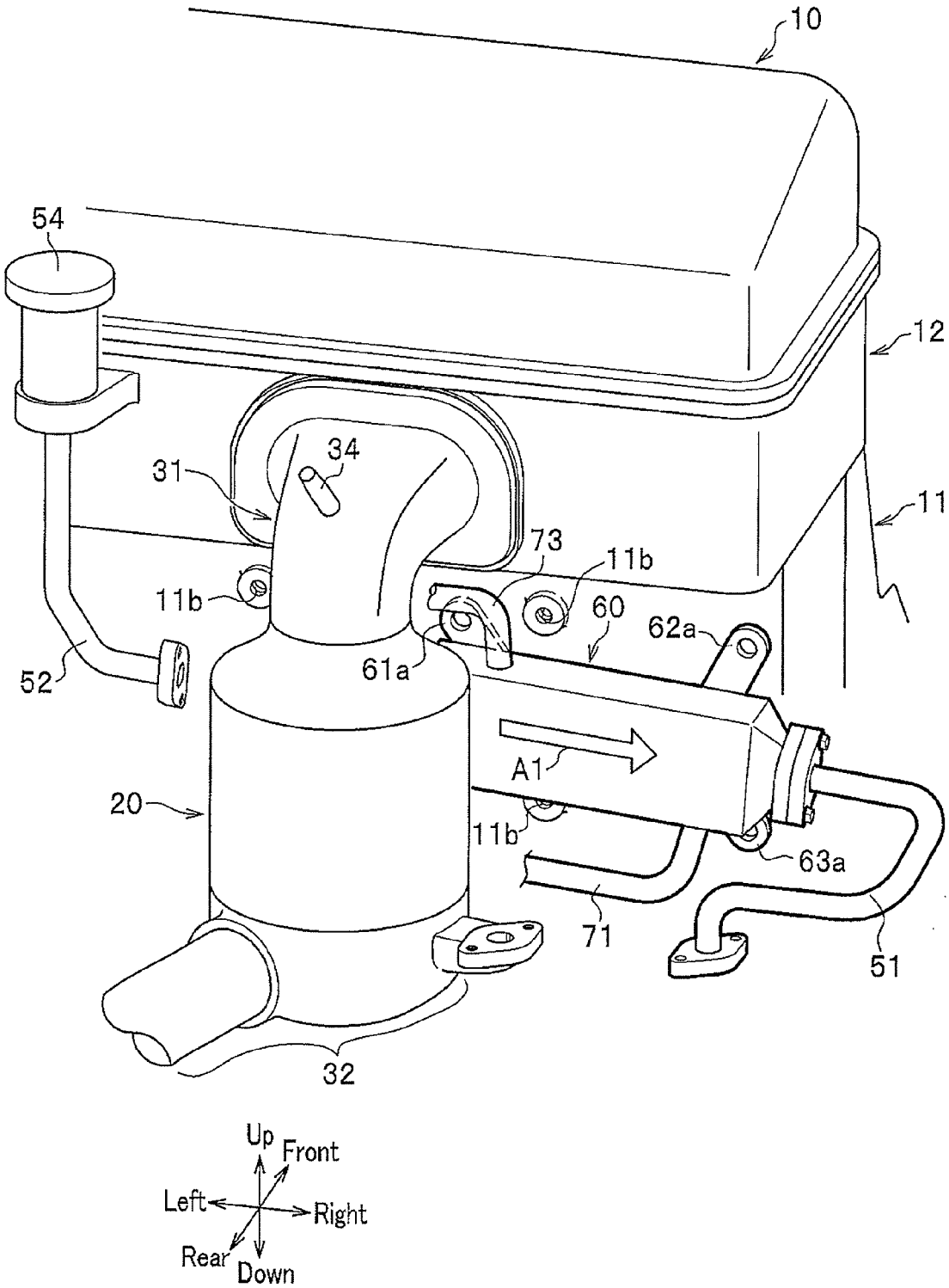
FIG. 7 is a perspective view of the EGR cooling structure of the embodiment with an EGR cooler being taken apart.

A cooling liquid pipe 70 is a pipe through which cooling liquid is made to flow into and out of the EGR cooler 60 and includes a cooling liquid flow-in pipe 71, a cooling liquid flow-in hose 72, a cooling liquid flow-out pipe 73 and a cooling liquid flow-out hose 74 (See FIG. 6). Both the cooling liquid flow-in pipe 71 and the cooling liquid flow-out pipe 73 are made of metal (for example, stainless steel) and both the cooling liquid flow-in hose 72 and the cooling liquid flow-out hose 74 are made of rubber or resin.

The cooling liquid to be used is, for example, antifreeze liquid whose main component is ethylene glycol or oil with a low viscosity.

A downstream end of the cooling liquid flow-in pipe 71 is connected with an cooling liquid inlet of the EGR cooler 60 and a downstream end of the cooling liquid flow-in hose 72 is connected with an upstream end of the cooling liquid flow-in pipe 71. An upstream end of the cooling liquid flow-out pipe 73 is connected with a cooling liquid outlet of the EGR cooler 60 and an upstream end of the cooling liquid flow-out hose 74 is connected with a downstream end of the cooling liquid flow-out pipe 73.

After the cooling liquid flows through a radiator (not shown) where heat of the cooling liquid is dissipated and is cooled, the cooling liquid flows through the cooling liquid flow-in hose 72, the cooling liquid flow-in pipe 71, the EGR cooler 60, the cooling liquid flow-out pipe 73 and the cooling liquid flow-out hose 74 in this order. The cooling liquid cools the EGR gas while flowing in the EGR cooler 60.

The cooling liquid flows to the radiator as mentioned after flowing out of the cooling liquid flow-out hose 74. Accordingly the cooling liquid circulates between the EGR cooler 60 and the radiator. There is a pump installed in the circulation circuit of the cooling liquid to pressurize and send out the cooling liquid.

Looking at the cylinder block 11 from its rear side, that is, from the side of the exhaust emission control device 20, the cooling liquid flow-in hose 72 and the cooling liquid flow-out hose 74, both of which are made of rubber or resin, are seen outside the exhaust emission control device 20 (See FIG. 5) and prevented from deteriorating due to heat from the exhaust emission control device 20. That is, a first connection part of the cooling liquid flow-in pipe 71 and the cooling liquid flow-in hose 72 and a second connection part of the cooling liquid flow-out pipe 73 and the cooling liquid flow-out hose 74 are disposed outside and only the cooling liquid flow-in pipe 71 and the cooling liquid flow-out pipe 73, both of which are made of metal, are disposed within an area over which the exhaust emission control device 20 is projected from the rear side.

This flow passage lay-out enables preventing the cooling liquid flow-in hose 72 and the cooling liquid flow-out hose 74 from deteriorating due to heat from the exhaust emission control device 20 and freely changing the circulation passage of the cooling liquid by using the cooling liquid flow-in hose 72 and the cooling liquid flow-out hose 74, both of which are so flexible to be capable of being bent freely.

<Effect of EGR Cooling Structure>

According to the EGR cooling structure as explained, the following effects are obtained.

Since the EGR cooler 60 is disposed in the space S surrounded by the cylinder block 11, the cylinder head 12 (exhaust manifold portion) protruding rearward and the exhaust emission control device 20 (See FIG. 3), the space S is not left as a dead space and efficiently used, and the EGR cooling structure 1 is made smaller. Here, the cooling liquid flows through inside the EGR cooler 60. Therefore, though the EGR cooler 60 is surrounded by the cylinder block 11 and others which become hot, there is no risk of the EGR cooler 60 suffering any damage or heat deterioration.

In addition, since the cooling liquid at a low temperature flows through inside the EGR cooler 60, the EGR cooler 60 has a function of blocking heat transmission. For example, heat to be transmitted from the exhaust emission control device 20 to the cylinder block 11 can be blocked or reduced. Therefore, it is possible to have such a device as a knock sensor which does not have high heat resistance disposed between the EGR cooler 60 and the cylinder block 11.

Furthermore, as the cylinder block 11, the EGR cooler 60, the exhaust emission control device 20, a steering rod 102 and a dash panel 103 are disposed in this order toward the vehicle rear side from the cylinder block 11 (See FIG. 1), the EGR cooler 60 stays between the cylinder block 11 and the exhaust emission control device 20 and does not make direct contact with the steering rod 102 or the dash panel 103 when the front end of the vehicle collides and the cylinder block 11 (engine 10) moves rearward. Thus there is hardly a risk of the EGR cooler being badly deformed and the cooling liquid leaking out.

Since the EGR cooler is connected with the second exhaust gas pipe 32 through the first pipe 51 (EGR gas flow-in pipe) which is in a U-shape to be capable of absorbing vibration, vibration of the third exhaust gas pipe 33 is efficiently absorbed and hardly transmitted to the EGR cooler 60. Accordingly the durability of the EGR cooler 60 becomes higher because the vibration of the third exhaust gas pipe 33 is hardly transmitted to the EGR cooler 60 which is fixed to the cylinder block 11 and vibrates in synchronization with the engine 10.

Looking at the EGR cooling structure 1 from its rear side, the fixing portions 61*a* to 63*a* of the EGR cooler 60 are seen outside the exhaust emission control device 20. Therefore the EGR cooler 60 can be taken apart by using such a straight tool as a box driver without having the straight tool interfere with the exhaust emission control device 20.

Looking at the EGR cooling structure 1 from its rear side, the cooling liquid flow-in hose 72 and the cooling liquid flow-out hose 74 are disposed outside the exhaust emission control device 20, which prevents the cooling liquid flow-in hose 72 and the cooling liquid flow-out hose 74 from deteriorating due to the heat from the exhaust emission control device 20.

<Modification>

One embodiment of the present invention has been explained. It should be noted that the present invention is not restricted to the embodiment as explained. For example, the following is a modified embodiment of the present invention.

In the above explained embodiment, the cylinder head 12 has an exhaust manifold portion in its inner structure in which there is the exhaust manifold port 12*b* into which the exhaust gas from each cylinder is collectively discharged. However, a conventional exhaust manifold which is a separate part from the cylinder head and is connected with each of the exhaust ports of a cylinder head and introduces the exhaust gas from each of the exhaust ports of a cylinder head into a single pipe portion may be used instead.

In the above explained embodiment, the first pipe 51 (EGR gas flow-in pipe) is connected with the second exhaust gas pipe 32 disposed downstream from the exhaust emission control device 20. However, for example, the first pipe 51 may be connected with the first exhaust gas pipe 31 disposed upstream from the exhaust emission control device 20. Part of the EGR gas may be introduced into the EGR cooler 60 from the first exhaust gas pipe 31 upstream from the exhaust emission control device 20.

In the embodiment above explained, the exhaust emission control device 20 includes the three-way catalyst of a Pt type or a Rh type to purify HC, CO and NOx remaining in the exhaust gas. The exhaust emission control device 20 may be DPF (Diesel Particulate Filter) device or GPF (Gasoline Particulate Filter) device.

EXPLANATION OF NOTES

1 EGR cooling structure
10 Engine
11 Cylinder block
11*a* Cylinder
12 Cylinder head (Exhaust manifold portion)
12*b* Exhaust manifold port
20 Exhaust emission control device
31 First exhaust gas pipe
32 Second exhaust gas pipe
33 Third exhaust gas pipe
50 EGR pipe
51 First pipe (EGR gas flow-in pipe)
60 EGR cooler
61*a*, 62*a*, 63*a* Fixing portion
70 Cooling liquid pipe
72 Cooling liquid flow-in hose
74 Cooling liquid flow-out hose
S Space

What is claimed is:

1. An EGR cooling structure comprising;

a cylinder block having a plurality of cylinders;

an exhaust manifold portion in which exhaust gas exhausted from each of the plurality of cylinders is collected;

an exhaust emission control device for purifying the exhaust gas flowing from the exhaust manifold port;

an EGR pipe through which EGR gas of a part of the purified exhaust gas is introduced into an intake system, and an EGR cooler attached between parts of the EGR pipe for cooling the EGR gas with a cooling liquid, wherein an exhaust gas passage from each of the plurality of cylinders to the exhaust emission control device is curved downward toward the exhaust emission control device when the exhaust gas passage is viewed from a side of the exhaust gas passage and the EGR cooler is disposed in a space surrounded by the cylinder block, and the exhaust gas manifold portion and the exhaust emission control device and between the exhaust emission control device and the cylinder block so that the cylinder block, the EGR cooler and the exhaust emission control device are seen overlapped with one another when viewed from a side of the cylinder block on which the exhaust emission control device is disposed.

2. The EGR cooling structure as described in claim 1, wherein the EGR cooler is fixed to the cylinder block; the EGR pipe includes an EGR gas flow-in pipe made of a metal and connecting the EGR cooler with an exhaust gas pipe through which the exhaust gas flows; and the EGR gas flow-in pipe is in a U-shape to absorb vibration transmitted from the exhaust gas pipe.

3. The EGR cooling structure as described in claim 1, wherein the EGR cooler is detachably fixed to the cylinder block and has a plurality of fixing portions disposed outside the EGR emission control device in a way in which the plurality of fixing portions are seen when the cylinder block is viewed from a side of the EGR emission control device.

4. The EGR cooling structure as described in claim 1, further comprising; a cooling liquid flow-in pipe made of a metal and connected with the EGR cooler, the cooling liquid flow-in pipe through which the cooling liquid flows into the EGR cooler; a cooling liquid flow-in hose connected with an upstream end of the cooling liquid flow-in pipe and made of a rubber or a resin: a cooling liquid flow-out pipe made of a metal and connected with the EGR cooler, the cooling liquid flow-out pipe through which the cooling liquid flows out of the EGR cooler, and a cooling liquid flow-out hose connected with an downstream end of the cooling liquid flow-out pipe and made of a rubber or a resin, wherein the cooling liquid flow-in hose and the cooling liquid flow-out hose are disposed outside the exhaust emission control device when the cylinder block is viewed from a side of the exhaust gas emission control device.

5. The EGR cooling structure as described in claim 2, wherein the EGR cooler is detachably fixed to the cylinder block and has a plurality of fixing portions disposed outside the EGR emission control device in a way in which the plurality of fixing portions are seen when the cylinder block is viewed from a side of the EGR emission control device.

6. The EGR cooling structure as described in claim 2, further comprising; a cooling liquid flow-in pipe made of a metal and connected with the EGR cooler, the cooling liquid flow-in pipe through which the cooling liquid flows into the EGR cooler; a cooling liquid flow-in hose connected with an upstream end of the cooling liquid flow-in pipe and made of a rubber or a resin: a cooling liquid flow-out pipe made of a metal and connected with the EGR cooler, the cooling liquid flow-out pipe through which the cooling liquid flows out of the EGR cooler, and a cooling liquid flow-out hose connected with an downstream end of the cooling liquid flow-out pipe and made of a rubber or a resin, wherein the cooling liquid flow-in hose and the cooling liquid flow-out hose are disposed outside the exhaust emission control device when the cylinder block is viewed from a side of the exhaust gas emission control device.

* * * * *